US005655192A

United States Patent [19]

Denton et al.

[11] Patent Number: 5,655,192

[45] Date of Patent: Aug. 5, 1997

[54] METHOD AND APPARATUS FOR COMPACTION OF A LIQUID INK DEVELOPED IMAGE IN A LIQUID INK TYPE ELECTROSTATOGRAPHIC SYSTEM

[75] Inventors: Gary A. Denton, Lexington, Ky.; Henry R. Till, Fairport, N.Y.

[73] Assignee: Xerox Corporation, Stamford, Conn.

[21] Appl. No.: 627,240

[22] Filed: Apr. 1, 1996

[51] Int. Cl.[6] ..... G03G 15/10

[52] U.S. Cl. ..... 399/240; 399/241; 430/117

[58] Field of Search ..... 355/256, 273; 118/644, 645, 659, 660; 399/237, 241, 240, 168; 430/117, 118

[56] References Cited

U.S. PATENT DOCUMENTS

| | | | |
|---|---|---|---|
| 4,286,039 | 8/1981 | Landa | 430/119 |
| 4,984,025 | 1/1991 | Landa et al. | 355/273 X |
| 5,028,964 | 7/1991 | Landa et al. | 355/273 |
| 5,255,058 | 10/1993 | Pinhas et al. | 355/256 |
| 5,276,492 | 1/1994 | Landa et al. | 355/277 |
| 5,408,299 | 4/1995 | Haas | 355/256 |
| 5,519,473 | 5/1996 | Morehouse, Jr. et al. | 355/256 |

*Primary Examiner*—Arthur T. Grimley
*Assistant Examiner*—Sophia S. Chen
*Attorney, Agent, or Firm*—Denis A. Robitaille

[57] ABSTRACT

A method and apparatus for compacting a liquid ink developed image on an image bearing surface in a multicolor electrostatographic printing machine of the type utilizing liquid developing material, particularly an image-on-image type liquid ink multicolor system. The image compacting apparatus includes a biased electrode situated proximate to the image on an image bearing surface, and a liquid applicator for depositing liquid insulating material in a conditioning gap defined by the electrode and the image bearing surface. A high electric potential is applied to the electrode for generating a large electric field in the gap to electrostatically compress toner particles into image areas on the image bearing surface. The liquid insulating material is deposited into the conditioning gap for avoiding the risk of air breakdown as may occur in an electrostatic device of this nature due to the small geometry of the apparatus and the tendency of air ionization in an air gap between electrically biased surfaces. Preferably, the liquid insulating material is the very same material utilized as the liquid carrier component of the liquid developing material.

22 Claims, 3 Drawing Sheets

METHOD AND APPARATUS FOR COMPACTION OF A LIQUID INK DEVELOPED IMAGE IN A LIQUID INK TYPE ELECTROSTATOGRAPHIC SYSTEM

This invention relates generally to a liquid ink-type electrostatographic printing machine, and more particularly concerns a method and apparatus for compacting a liquid ink developed image on an image bearing surface in a liquid ink type multicolor electrostatographic printing machine.

Generally, the process of electrostatographic copying is initiated by exposing a light image of an original document to a substantially uniformly charged photoreceptive member. Exposing the charged photoreceptive member to light in an imagewise configuration discharges the photoconductive surface thereof in areas corresponding to non-image areas in the original input document while maintaining the charge in image areas, resulting in the creation of a latent electrostatic image of the original document on the photoreceptive member. This latent image is subsequently developed into a visible image by a process in which developer material is deposited onto the surface of the photoreceptive member. Typically, this developer material comprises carrier granules having toner particles adhering triboelectrically thereto, wherein the toner particles are electrostatically attracted from the carrier granules to the latent image for forming a developed powder image on the photoreceptive member. Alternatively, liquid developer materials comprising a liquid carrier material having toner particles dispersed therein have been successfully utilized, wherein the liquid developer material is applied to the latent image with the toner particles being attracted toward the image areas to form a developed liquid image. Regardless of the type of developer material employed, the toner particles of the developed image are subsequently transferred from the photoreceptive member to a copy substrate, either directly or by way of an intermediate transfer member. Thereafter, the image may be permanently affixed to the substrate for providing a "hard copy" reproduction or print of the original document or file. In a final step, the photoreceptive member is cleaned to remove any charge and/or residual developing material from the photoconductive surface in preparation for subsequent imaging cycles.

The above described electrostatographic reproduction process is well known and is useful for light lens copying from an original as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the discharged area, known as DAD, or "write black" systems, as distinguished from so-called light lens generated image systems which develop toner on the charged areas, also known as CAD, or "write white" systems. The subject invention applies to both such systems.

In recent years, it has become highly desirable to provide the capability of producing color output prints through the use of electrostatic printing processes. Electrostatographic printing machines generally utilize a so-called subtractive color mixing process to produce a color output image, whereby a full gamut of colors are created from three colors, namely cyan, magenta and yellow. These colors are complementary to the three primary colors, with light being progressively subtracted from white light.

Various methods can be utilized to produce a full process color image using cyan, magenta, and yellow toner images. One exemplary method of particular interest to the present invention for producing a process color image is described as the Recharge, Expose, and Development (REaD) process, wherein different color toner layers are deposited in superimposed registration with one another on a photoconductive surface or other recording medium to create a multilayered, multicolored, toner image thereon. In this process, the recording medium is first exposed to record a latent image thereon corresponding to a subtractive color of an appropriately colored toner particle at a first development station. Thereafter, the recording medium having the first developed image thereon is recharged and re-exposed to record a latent image thereon corresponding to another subtractive primary color and developed once again with appropriately colored toner. The process is repeated until all the different color toner layers are deposited in superimposed registration with one another on the recording medium.

Variations on this general technique for forming color copies, wherein a first latent image is formed and developed and subsequent latent images are formed and developed to superimpose a plurality of toner images on one another are well known in the art, and may make advantageous use of the present invention. Using the typical electrostatographic printing process as an example, the REaD color process described hereinabove may be implemented via either of two architectures: a single pass, single transfer architecture, wherein multiple imaging stations, each comprising a charging unit, an imaging device, and a developing unit, are situated about a single photoconductive belt or drum; or a multipass, single transfer architecture, wherein a single imaging station comprising the charging unit, an imaging device, and multiple developer units are located about a photoconductive belt or drum. As the names imply, the single pass architecture requires a single revolution of the photoconductive belt or drum to produce a color image, while the multipass architecture requires multiple revolutions of the photoconductive belt or drum to produce the color print or copy. Various other techniques and systems have been successfully implemented, wherein each color separation is imaged and developed in sequence such that each developing station (except the first developing station) must apply toner to an electrostatic latent image over areas of toner where a previous latent image has been developed.

As previously noted, the use of liquid developer materials in imaging processes is well known. Likewise, the art of developing electrostatographic latent images formed on a photoconductive surface with liquid developer materials is also well known. Indeed, various types of liquid developing materials and development systems have heretofore been disclosed with respect to electrostatographic printing machines.

Liquid developers have many advantages, and often produce images of higher quality than images formed with dry toners. For example, images developed with liquid developers can be made to adhere to paper without a fixing or fusing step, thereby eliminating a requirement to include a resin in the liquid developer for fusing purposes. In addition, the toner particles can be made to be very small without the resultant problems typically associated with small particle powder toners, such as airborne contamination which can adversely affect machine reliability and can create potential health hazards. The use of very small toner particles is particularly advantageous in multicolor processes wherein multiple layers of toner generate the final multicolor output image. Further, full color prints made with liquid developers can be processed to a substantially uniform finish, whereas uniformity of finish is difficult to achieve with powder toners due to variations in the toner pile height as well as a need for thermal fusion, among other factors. Full color imaging with liquid developers is also economically attractive, particularly if surplus liquid carrier containing the toner particles can be economically recovered without cross contamination of colorants.

Liquid developer material typically contains about 2 percent by weight of fine solid particulate toner material dispersed in the liquid carrier, typically a hydrocarbon. After development of the latent image, the developed image on the photoreceptor may contain about 12 percent by weight of the particulate toner in the liquid hydrocarbon carrier. However, at this percent by weight of toner particles, developed liquid images tend to exhibit poor cohesive behavior which results in image smear during transfer and partial image removal, or so-called scavenging, during subsequent development steps, particularly in image-on-image color processes.

In order to improve the quality of transfer of the developed image to a copy sheet and to prevent image scavenging, the developed liquid image is typically "conditioned" by compressing or compacting the toner particles making up the image into the image areas so as to physically stabilize the image on the photoreceptor or other image bearing surface. Image conditioning may also include the removal of liquid carrier from the developed liquid image and preventing toner particles from departing the image for increasing the toner solids content thereof. Conditioning of the image prior to transfer greatly improves the ability of the toner particles to form a high resolution image on the final support substrate or an intermediate transfer member if one is employed.

Various devices and systems are known for effectively conditioning a liquid developed image. In one exemplary system, an electrically conductive roller device is utilized, wherein a bias is applied to the roller having a potential of the same polarity as the toner in the liquid developer such that the toner is repelled from the roller. By applying a biasing potential to the roller, toner particles are pushed away from the roller and into a compressed region on the surface upon which the developed image is being transported. In this type of system, the toner image may also be compacted by pressure contact of the roller against the image with the electrical bias applied to the roller repelling the toner particles from the roller surface.

Although numerous techniques and devices have been developed for conditioning an image in liquid based electrostatographic printing systems, some problems and inadequacies remain with respect to known electrostatically based systems. In particular, certain circumstances may arise in which the formation of electrostatic charges used to compact the image involve ionic conduction through an air gap. That is, air pockets may exist between the roller or other electrode and the image on the photoreceptor. It is known that when two conductors are positioned in close proximity, with a voltage potential applied between the two, electrical discharge will occur when the voltage potential and field generated thereby exceeds the Paschen Curve. This condition creates the phenomenon known as air breakdown, where the air is ionized such that opposite polarity ions will move in opposite directions, reducing the electric field in the air gap. More importantly, ions produced during air breakdown may change the polarity of toner particles such that the toner particles will be attracted away from image areas on the photoreceptor. Clearly, this is an undesirable result.

The present invention is directed toward an electrostatic image compaction device in which image compaction is accomplished solely by subjecting the image to a large electric field, wherein a conditioning gap is filled with insulating liquid material in order to avoid the risk of air breakdown. The following disclosures may be relevant to some aspects of the present invention:

U.S. Pat. No. 4,286,039

Patentee: Landa et al.

Issued: Aug. 25, 1981

U.S. Pat. No. 4,796,048

Patentee: Bean

Issued: Jan. 3, 1989

U.S. Pat. No. 5,028,964

Patentee: Landa et al.

Issued: Jul. 2, 1991

U.S. Pat. No. 5,276,492

Patentee: Landa et al

Issued: Jan. 4, 1994

The relevant portions of the foregoing patents may be briefly summarized as follows:

U.S. Pat. No. 4,286,039 discloses an image forming apparatus comprising a deformable polyurethane roller, which may be a squeegee roller or blotting roller which is biased by a potential having a sign the same as the sign of the charged toner particles in a liquid developer. The bias on the polyurethane roller is such that it prevents streaking, smearing, tailing or distortion of the developed electrostatic image and removes much of the liquid carrier of the liquid developer from the surface of the photoconductor.

U.S. Pat. No. 4,796,048 discloses a resilient intermediate transfer member and apparatus for liquid ink development, wherein a plurality of liquid images are transferred from a photoconductive member to a copy sheet. The liquid images, which include a liquid carrier having toner particles dispersed therein, are attracted from the photoconductive member to an intermediate belt by a biased transfer roll, such that the liquid carrier is squeegeed from the intermediate belt and the toner particles are compacted thereon in image configuration. Thereafter, the toner particles are transferred from the intermediate belt to the copy sheet in image configuration with the use of another biased transfer roll.

U.S. Pat. No. 5,028,964 discloses an apparatus for image transfer which comprises an intermediate transfer member and a squeegee for removing excess liquid from the toner image prior to transferring an image. The intermediate transfer member is operative for receiving the toner image therefrom and for transferring the toner image to a receiving substrate. Transfer of the image to the intermediate transfer member is aided by providing electrification of the intermediate transfer member to a voltage having the same bias as that of the charged particles. The roller is charged to a potential having the same polarity as the charge of the toner particles of the liquid developer.

U.S. Pat. No. 5,276,492 discloses an imaging method and apparatus for transferring liquid toner images from an image forming surface to an intermediate transfer member for subsequent transfer to a final substrate, wherein the liquid toner images include carrier liquid and pigmented polymeric toner particles which are essentially nonsoluable in the carrier liquid at room temperature, and which form a single phase at elevated temperatures. That patent describes a method which include the steps of; concentrating the liquid toner image by compacting the solids portion of the liquid toner image and removing carrier liquid therefrom; transferring the liquid toner image to the intermediate transfer member; heating the liquid toner image on the intermediate transfer member to a temperature at which the toner particles and the carrier liquid form a single phase; and transferring the heated liquid toner image to a final substrate.

In accordance with one aspect of the present invention, there is provided an apparatus for compacting a liquid ink developed image on an image bearing surface, comprising an electrically biased electrode having a surface situated proximate the image bearing surface, defining a conditioning gap therebetween and a liquid material applicator for flooding the conditioning gap with a liquid insulating material to avoid air breakdown in the conditioning gap.

In accordance with another aspect of the present invention, a liquid ink type electrostatographic printing machine is provided, including an apparatus for compacting a liquid ink developed image on an image bearing surface. The compacting apparatus comprises an electrically biased electrode having a surface situated proximate the image bearing surface, defining a conditioning gap therebetween; and a liquid material applicator for flooding the conditioning gap with a liquid insulating material to avoid air breakdown in the conditioning gap.

In accordance with another aspect of the present invention, a liquid ink type multicolor electrostatographic printing machine is provided, wherein a plurality of liquid ink developed images are deposited in superimposed registration with one another on an imaging surface for creating a multicolored, multilayered image thereon, including an apparatus for compacting a liquid ink developed image layer on the imaging surface. The compacting apparatus comprises an electrically biased electrode having a surface situated proximate the imaging surface, defining a conditioning gap therebetween; and a liquid material applicator for flooding the conditioning gap with a liquid insulating material to avoid air breakdown in the conditioning gap.

In accordance with yet another aspect of the present invention, a method for compacting a liquid ink developed image on an image bearing surface, comprising the steps of: providing an electrically biased electrode having a surface situated proximate the image bearing surface, defining a conditioning gap therebetween; and flooding the conditioning gap with a liquid insulating material to avoid air breakdown in the conditioning gap.

Other aspects of the present invention will become apparent as the following description proceeds and upon reference to the drawings, in which.

Figure 3:
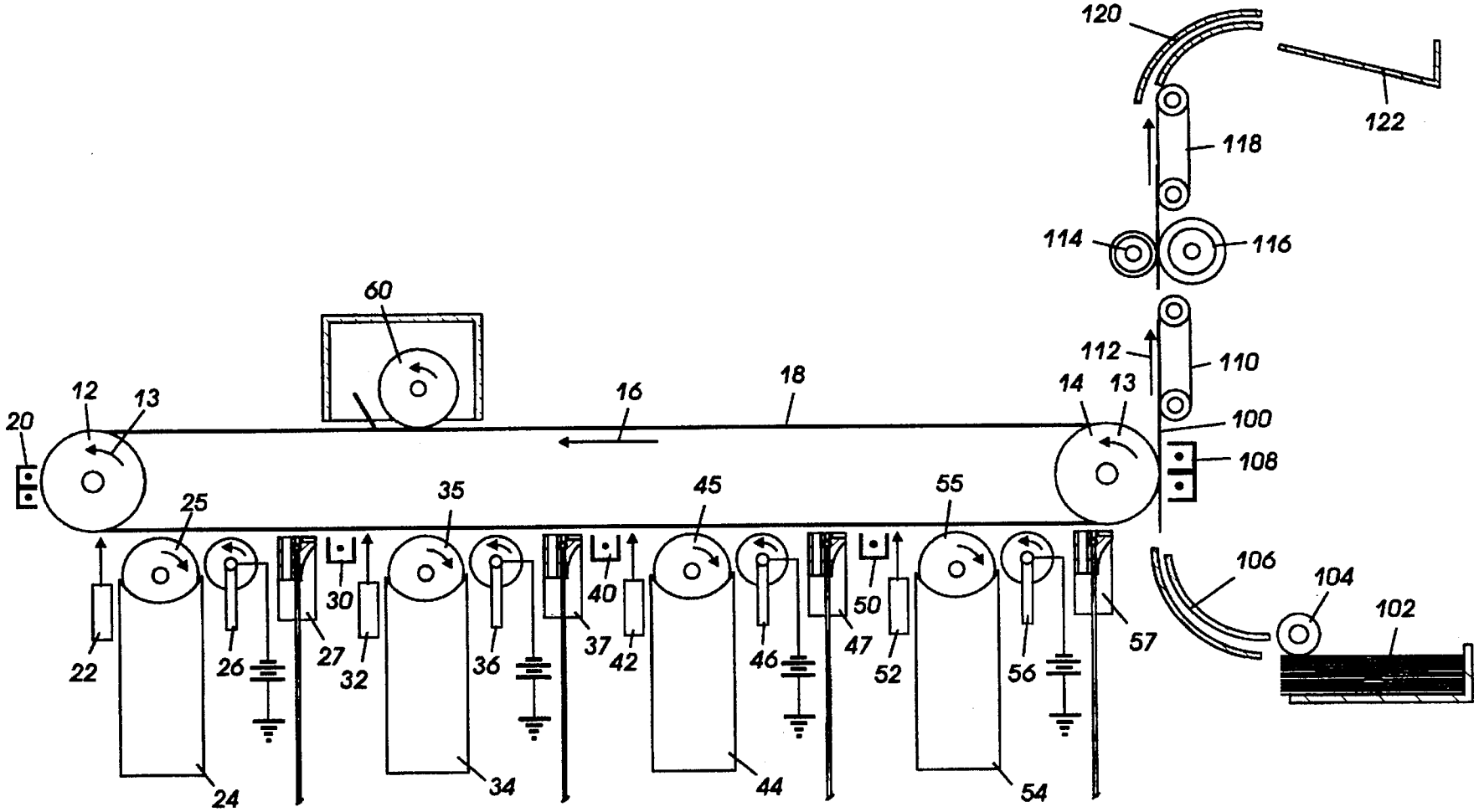
FIG. 3 is a schematic, elevational view of a liquid-based image-on-image color electrostatographic printing machine incorporating an apparatus for compacting a liquid ink developed image in accordance with the present invention.

For a general understanding of the features of the present invention, reference is made to the drawings, wherein like reference numerals have been used throughout to designate identical elements. FIG. 3 is a schematic elevational view illustrating a full-color, liquid developing material type electrostatographic printing machine incorporating the features of the present invention. Inasmuch as the art of electrostatographic printing is well known, the various processing stations employed in the printing machine of FIG. 3 will be described briefly with reference thereto. It will become apparent from the following discussion that the apparatus of the present invention may be equally well-suited for use in a wide variety of printing machines and is not necessarily limited in its application to the particular electrostatographic described herein. Moreover, while the present invention will hereinafter be described in connection with a preferred embodiment thereof, it will be understood that the description of the invention is not intended to limit the invention to this preferred embodiment. On the contrary, the description is intended to cover all alternatives, modifications, and equivalents as may be included within the spirit and scope of the invention as defined by the appended claims.

Turning now to FIG. 3, a liquid developing material based multicolor electrostatographic printing machine incorporating the features of the present invention is illustrated in schematic form. The printing machine employs a photoreceptor in the form of a continuous multilayered belt member 18 including a photoconductive surface deposited on an electrically grounded conductive substrate. The photoreceptor is entrained about rollers 12 and 14 which are rotated in the direction of arrows 13 for transporting the belt along a curvilinear path in the direction of arrow 16, thereby advancing successive portions of the photoreceptive belt 18 through the various processing stations disposed about the path of movement thereof.

The electrostatographic printing process is initiated by applying a substantially uniform charge potential to the photoreceptive member 18. Thus, the initial processing station shown in FIG. 3 is a charging station including a corona generating device 20 capable of spraying ions onto the surface of the photoreceptor for applying a relatively high, substantially high charge potential thereto.

After the substantially uniform charge is placed on the photoreceptive surface of belt 18, the electrostatographic printing process proceeds by either imaging an input document placed on the surface of a transparent imaging platen (not shown) or by providing a computer generated image signal for selectively discharging the photoconductive surface in accordance with the image to be generated. For multicolor printing and copying, the imaging process involves separating the imaging information into the three primary colors to provide a series of subtractive imaging signals, with each subtractive imaging signal being proportional to the intensity of the incident light of each of the primary colors. These imaging signals are then transmitted to a series of individual raster output scanners (ROSs), shown schematically by reference numerals 22, 32, 42 and 52, for generating complementary, color separated latent images on the charged photoreceptive belt 18. Typically, each ROS 22, 32, 42 and 52 writes the latent image information in a pixel by pixel manner.

In the exemplary electrostatographic system of FIG. 3, each of the color separated electrostatic latent images are serially developed on the photoreceptive belt 18 via a donor roll developing apparatus 24, 34, 44 and 54. In a typical donor roll developing apparatus, as illustrated in FIG. 3, a donor roll 25, 35, 45 or 55 is coated with a layer of appropriately colored developer material, and is rotated to transport the toner to the surface of belt 18, where the latent image on the surface of belt 18 attracts the toner thereto for producing the visible developed image. It will be understood that the developer roll can be rotated either in the same direction of travel as the photoreceptor belt 18 or opposite the direction of travel thereof, as depicted in FIG. 3. The donor roll may also be electrically biased to a suitable magnitude and polarity for enhancing the attraction of the toner particles to the latent image. Each of the developer units 24, 34, 44 and 54 shown in FIG. 3 are substantially identical to one another and represent only one of various known apparatus that can be utilized to apply developing material to the photoconductive surface or any other type of recording medium.

As previously noted, the present invention is directed to an electrostatographic printing system which utilizes liquid developer materials. Thus, each developing apparatus transports a different color liquid developing material into contact with the electrostatic latent image on the photoreceptor surface so as to develop the latent image with pigmented toner particles, creating a visible image. By way of example, developing apparatus 24 transports cyan colored liquid developer material, developing apparatus 34 transports magenta colored liquid developer material, developing apparatus 44 transports yellow colored liquid developer material, and developing apparatus 54 transports black colored liquid developer material. Each different color liquid developing material comprises pigmented toner particles in a liquid carrier medium, wherein the toner particles are charged to a polarity opposite in polarity to the latent image on the photoconductive surface of belt 18 such that the toner particles are attracted to the electrostatic latent image to create a visible developed image thereof.

Generally, in a liquid developing material-based system, the liquid carrier medium makes up a large amount of the liquid developer composition. Specifically, the liquid medium is usually present in an amount of from about 80 to about 98 percent by weight, although this amount may vary from this range. By way of example, the liquid carrier medium may be selected from a wide variety of materials, including, but not limited to, any of several hydrocarbon liquids, such as high purity alkanes having from about 6 to about 14 carbon atoms exemplified by such commercial products as: Norpar® 12; Norpar® 13; and Norpar® 15; as well as isoparaffinic hydrocarbons such as Isopar® G, H, L, and M, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons may provide a preferred liquid media since they are colorless, environmentally safe, and possess a sufficiently high vapor pressure so that a thin film of the liquid evaporates from the contacting surface within seconds at ambient temperatures.

The toner particles utilized in liquid developer compositions can be any pigmented particle compatible with the liquid carrier medium, such as, for example, those contained in the developers disclosed in U.S. Pat. Nos. 3,729,419; 3,841,893; 3,968,044; 4,476,210; 4,707,429; 4,762,764; 4,794,651; and 5,451,483, the disclosures of each of which are totally incorporated herein by reference. The toner particles should have an average particle diameter from about 0.2 to about 10 microns, and preferably from about 0.5 to about 2 microns. The toner particles may be present in amounts of from about 1 to about 10 percent by weight, and preferably from about 1 to about 4 percent by weight of the developer composition. The toner particles can consist solely of pigment particles, or may comprise a resin and a pigment; a resin and a dye; or a resin, a pigment, and a dye. Suitable resins include poly(ethyl acrylate-co-vinyl pyrrolidone), poly(N-vinyl-2-pyrrolidone), and the like. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, and the like, all available from Sandoz Company, Mississauga, Ontario, among other manufacturers. Dyes generally are present in an amount of from about 5 to about 30 percent by weight of the toner particle, although other amounts may be present provided that the objectives of the present invention are achieved. Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion color company), cyan pigments such as Sudan Blue OS (BASF), and the like. Generally, any pigment material is suitable provided that it consists of small particles and that combine well with any polymeric material also included in the developer composition. Pigment particles are generally present in amounts of from about 5 to about 40 percent by weight of the toner particles, and preferably from about 10 to about 30 percent by weight.

In addition to the liquid carrier vehicle and toner particles which typically make up the liquid developer materials suitable for the present invention, a charge control additive, sometimes referred to as a charge director, may also be included for facilitating and maintaining a uniform charge on toner particles by imparting an electrical charge of selected polarity (positive or negative) to the toner particles. Examples of suitable charge control agents include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight, and preferably from about 0.02 to about 0.05 percent by weight of the developer composition.

After image development, the amount of liquid developing material deposited on the surface of the photoreceptor belt 18 is preferably reduced. To this end, metering rollers 26, 36, 46 and 56 are positioned slightly downstream of and adjacent to respective developing material applicators 25, 35, 45 and 55, in the direction of movement of the photoreceptor 18. The peripheral surface of each metering roller, for example metering roller 26, is situated in close proximity to the surface of the photoreceptor 18 without actually contacting the surface of the photoreceptor 18 or the developed image thereon so as to prevent blurring or distortion of the image thereby. In addition, the peripheral surface of the metering roller 26 is preferably rotated in a direction opposite the path of movement of the photoreceptor in order to create a substantial shear force against the thin layer of developing material present between it and the photoreceptor 18 for minimizing the amount of the developing material deposited on the photoconductive surface. This shear force removes a predetermined amount of excess developing material from the surface of the photoreceptor and transports this excess developing material in the direction of the developing material applicator 25, with the excess developing material eventually falling away from the rotating metering roll 26 for collection in a sump or other liquid developer collection and reclaim system. As shown, the metering roll 26 may be electrically biased by supplying an AC or a DC voltage thereto for providing additional treatment of the image on the photoreceptor. For example, by providing a predetermined electrical bias at the metering roll which has the same polarity as the charge on the developed image, inhibits removal of deposited toner particles from the surface of the photoreceptor due to the shear forces created by the movement of the metering roll. Conversely, by providing a predetermined electrical bias at the metering roll which is opposite in polarity to the charge of the developed image, background image removal could be induced.

After the above metering process is completed, the liquid image on the photoconductor is, in accordance with the present invention, further processed or "conditioned" to compress or compact the image onto the surface of the photoreceptor and to remove some of the liquid carrier therefrom, as shown, for example, by U.S. Pat. No. 4,286,039, among various other patents. The present invention contemplates a method and apparatus for compaction of a liquid ink developed image, whereby the image on the photoreceptor is subjected to a large electric field created in a conditioning gap between a closely spaced electrode member and the surface of the photoreceptor. In addition, the present invention contemplates that the conditioning gap will be flooded with an insulative fluid, such as the liquid carrier medium in the liquid developer material, in order to avoid the risk of air breakdown as may be caused by the high biasing potential applied to the electrode. One embodiment of an image conditioning apparatus in accordance with the present invention is shown at reference numerals 27, 37, 47 and 57, each comprising a liquid material delivery apparatus having a conductive element which is biased to a high potential of a polarity opposite the toner image for electrostatically compacting the toner particles onto the image on the photoreceptor 18 while inhibiting the departure of toner particles from the image areas on the surface thereof. The detailed structure of the image conditioning apparatus, and the operation thereof, with respect to the present invention will be described hereinafter with reference to FIGS. 1 and 2.

Continuing with a general description of the multicolor liquid electrostatographic printing process, following image conditioning of the first developed image, belt 18 continues to advance in the direction of arrow 16 to a recharge station where corona generating device 30 recharges the photoconductive surface of belt 18 to a substantially uniform potential. Thereafter, the belt continues to travel to the next exposure station, where ROS 32 selectively dissipates the charge laid down by corotron 30 to record another color separated electrostatic latent image corresponding to regions to be developed with a magenta developer material. This color separated electrostatic latent image may be totally or partially superimposed on the developed cyan image on the photoconductive surface. Thereafter, the electrostatic latent image is now advanced to the next successive developing apparatus 34 which deposits magenta toner thereon.

After the electrostatic latent image has been developed with magenta toner, the photoconductive surface of belt 18 continues to be advanced in the direction of arrow 16 to the next metering roll 36, to the next image conditioning station 37 and onward to corona generating device 40, which, once again, charges the photoconductive surface to a substantially uniform potential. Thereafter, ROS 42 selectively discharges this new charge potential on the photoconductive surface to record yet another color separated electrostatic latent image, which may be partially or totally superimposed on the prior cyan and magenta developed images, for development with yellow toner. In this manner, a yellow toner image is formed on the photoconductive surface of belt 18 in superimposed registration with the previously developed cyan and magenta images. It will be understood that the color of the toner particles at each development station may be provided in am arrangement and sequence that is different than described herein.

After the yellow toner image has been formed on the photoconductive surface of belt 18, the belt 18 continues to advance to the next metering roller 46, image conditioning station 47, and onward to recharge station 50 and corresponding ROS 52 for selectively discharging those portions of belt 18 which are to be developed with black toner. In this final development step, black images are developed via a process known as black undercolor removal process, wherein the developed image is located only on those portions of the photoconductive surface adapted to have black in the printed page and may not be superimposed over the prior cyan, magenta, and yellow developed images. This final developed image is once again metered and image conditioned at an image conditioning station 57 to compact the image on the photconductive belt 18.

Using the process described hereinabove, a composite multicolor toner image is formed on the photoconductive surface of belt 18. It will be recognized that the present description is directed toward a Recharge, Expose, and Develop (REaD) process, wherein the charged photoconductive surface of photoreceptive belt 18 is serially exposed to record a series of latent images thereon corresponding to the subtractive color of one of the colors of the appropriately colored toner particles at a corresponding development station. Thus, the photoconductive surface is continuously recharged and re-exposed to record latent images thereon corresponding to the subtractive primary of another color of the original. This latent image is therefore serially developed with appropriately colored toner particles until all the different color toner layers are deposited in superimposed registration with one another on the photoconductive surface. It should be noted that either discharged area development (DAD) discharged portions are developed, or charged area development (CAD), wherein charged areas are developed can be employed, as will be described.

After the composite multicolor image is formed on the photoreceptor, the multilayer developed image may be further conditioned with corona and/or light and then advanced to a transfer station, whereat a sheet of support material 100, typically a sheet of paper or some similar sheetlike substrate, is advanced from a stack 102 by a feed roll 104. The sheet advances through a chute 106 and is guided to the transfer station at which a corona generating device 108 directs ions onto the back side of the support material 100 for attracting the composite multicolor developed image on belt 18 to the support material 100. While direct transfer of the composite multicolor developed image to a sheet of paper has been described, one skilled in the art will appreciate that the developed image may be transferred to an intermediate member, such as a belt or drum, and then, subsequently, transferred and fused to the sheet of paper, as is well known in the art.

After the image has been transferred to the support substrate, the conveyor belt 110 moves the sheet of paper in the direction of arrow 112 to a drying or fusing station. The fusing station includes a heated roll 114 and back-up or pressure roll 116 resiliently urged into engagement with one another to form a nip through which the sheet of paper passes. The fusing station operates to affix the toner particles to the copy substrate so as to bond the multicolor image thereto. After fusing, the finished sheet is discharged onto a conveyor 118 which transports the sheet to a chute 120 and guides the sheet into a catch tray 122 for removal therefrom by the machine operator.

Often, after the developed image is transferred from belt 18, residual developer material tends to remain, undesirable, on the surface thereof. In order to remove this residual toner from the surface of the belt 18, a cleaning roller 60, typically formed of an appropriate synthetic resin, is driven in a direction opposite to the direction of movement of belt 18 for contacting and cleaning the surface thereof. It will be understood that a number of photoconductor cleaning means exist in the art, any of which would be suitable for use with the present invention.

The foregoing discussion provides a general description of the operation of a liquid developing material based electrostatographic printing machine incorporating the development apparatus of the present invention therein. The detailed structure of the development apparatus will be described hereinafter with reference to FIGS. 1 and 2.

Figure 1:
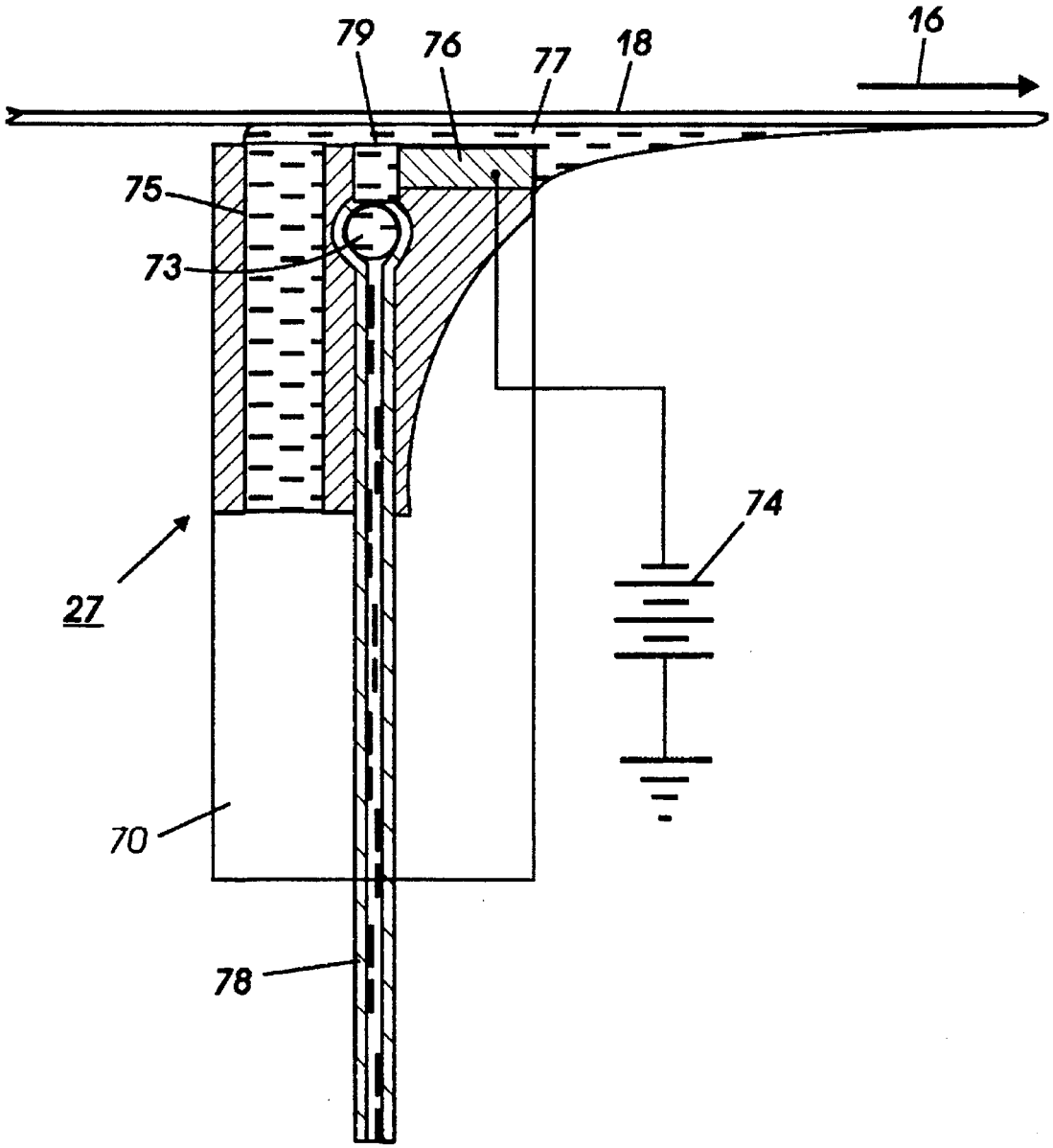
FIG. 1 is a schematic elevational view of one embodiment of an apparatus for compacting a liquid ink developed image in accordance with the present invention.

Referring now to FIG. 1 a first embodiment of the image compaction apparatus in accordance with the present invention will be described with an understanding that the image conditioning apparatus 27, 37, 47 and 57, shown and described with respect to the multicolor electrostatographic printing system of FIG. 3 are substantially identical thereto. In general, the only distinction between the image conditioning apparatus is the color of the liquid image being conditioned.

As depicted in FIG. 1, the preferred embodiment of the image compaction apparatus in accordance with the present invention includes a liquid insulating material applicator 70 having an integral conductive electrode element 76 situated adjacent to, and in close proximity (approximately 2 to 4 mils) to the surface of photoreceptive belt 18. Conductive electrode 76 is coupled to an electrical biasing source 74, preferably applying to the conductive electrode a 500 to 2000 volt potential relative to the conductive ground plane of the photoreceptor, having a polarity identical to the polarity of the charged toner particles, for generating a large electric field in the gap between the electrode and the image bearing surface of the photoreceptor. This gap will be referred to as the conditioning gap 77. As can be seen from FIG. 1, in accordance with the present invention, the conditioning gap is flooded with liquid insulating material to avoid the risk of air breakdown. It will be understood that the liquid insulating material utilized by the present invention may be, and indeed preferably is, the very same material which makes up the liquid carrier portion of the liquid developing material as described previously herein. To that end, one advantage to the approach contemplated by the present invention is that it would not be necessary to remove the liquid insulating material applied by the liquid insulating material applicator 70 prior to a subsequent developing step since development could be accomplished directly through the liquid insulating material on the image bearing surface (of course, the clear liquid insulating material could be metered away by means of an additional reverse metering roll if necessary or desirable). In fact, the carrier fluid could be substituted for the liquid insulating material by detoning the 2% solids by weight developing material via any known fluid separation process, as described, for example, in U.S. Pat. No. 5,036,365.

In the embodiment of FIG. 1, the liquid insulating material applicator 70 comprises a housing of single piece construction, fabricated from a suitable conductive or non-conductive material such as a polycarbonate or other reinforced polymer based material, whereby fabrication and manufacturing can be accommodated by other than heavy duty machining or via plastic extrusion. The applicator 70 includes an elongated aperture 79 extending along a longitudinal axis thereof so as to be oriented substantially transverse to the belt 18 along the direction of travel thereof, as indicated by arrow 16. The aperture 79 provides a path of travel for delivery of insulative liquid material being transported by the applicator and also defines a liquid material application region in which the insulative liquid material can freely flow for filling the gap between the conductive electrode 76 and the surface of the photoreceptor belt 18.

Liquid insulating material is transported to aperture 79 via a pair of inlet ports 73 coupled to the elongated aperture 79, located at opposite ends thereof. The inlet ports are further coupled to a supply of liquid insulating material via supply conduit 78. An overflow drainage channel 75 partially surrounds the aperture 79 for collecting excess liquid insulating material which may not flow into the gap between the electrode 76 and the photoreceptor 18. The overflow channel 75 also acts as an outlet port for removal of excess or extraneous liquid insulating material and, preferably, for directing this excess insulating material to the liquid insulating material supply so that the liquid insulating material can be collected and recycled for subsequent use either in the liquid developer or as the liquid insulating material used in the image conditioning apparatus of the present invention. In this manner, liquid insulating material is pumped through supply conduit 78 to the inlet ports 73 and into the elongated aperture 79 such that the liquid insulating material flows out of the elongated aperture 79 and into contact with the surface of photoreceptor belt 18, while excess liquid insulating material flows away from the conditioning gap formed between the photoreceptor and the conditioning apparatus via overflow channel 75.

In operation, liquid insulating material flows in the direction of the photoreceptor 18, filling the gap between the photoreceptor 18 and the liquid applicator 27. As the photoreceptor belt 18 moves in the direction of arrow 16, a portion of the liquid insulating material moves therewith, filling the conditioning gap between the conductive electrode 76 and the photoreceptor surface. The bias applied to the conductive electrode 76 causes the toner particles making up the developed image on the photoreceptor surface to be repelled, and therefore compressed or compacted onto the surface of the photoreceptor.

Figure 2:
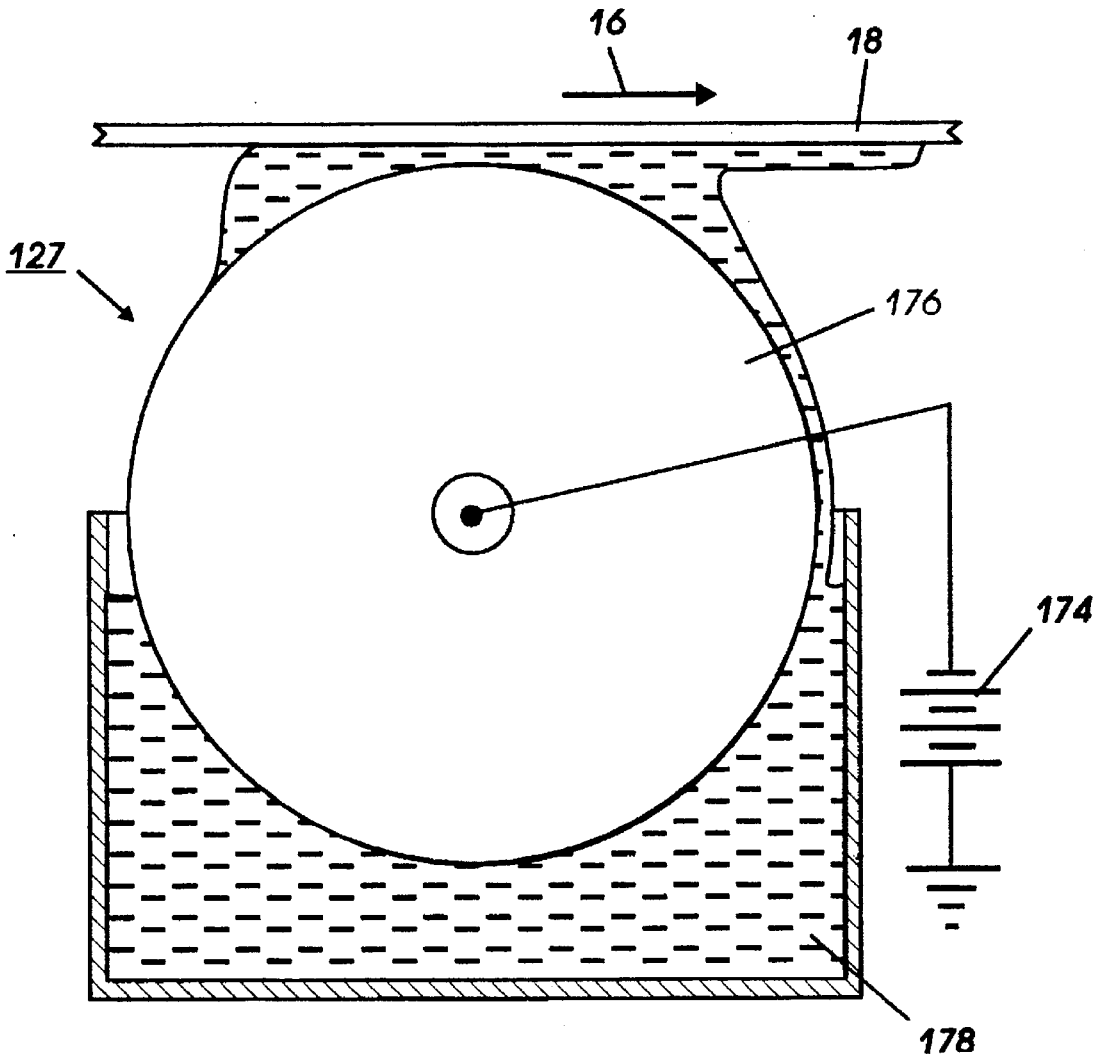
FIG. 2 is a schematic elevational view of a second embodiment of an apparatus for compacting a liquid ink developed image in accordance with the present invention.

An alternative embodiment of an apparatus for compacting a liquid ink developed image on an image bearing surface in accordance with the present invention is shown in FIG. 2. In this embodiment, the liquid material applicator, identified by reference numeral 127, takes the form of an applicator roller 176 which is electrically biased by voltage source 174. The applicator roller 176 is rotated either in the same direction as the photoreceptor or in a direction opposite the direction of movement of the photoconductor surface, wherein the peripheral surface thereof passes through a supply bath 178 of liquid insulating material so as to transport liquid insulating material from the supply bath 178 to the surface of the photoreceptor. As in the embodiment of FIG. 1, the peripheral surface of the applicator roller 176 is situated in close proximity to the surface of the photoconductor, preferably within 2 to 4 mils, for minimizing the thickness of the liquid layer in the conditioning gap and for generating a strong electric field between the applicator roller 176 and the surface of the photoreceptor 18. In this embodiment, excess liquid insulating material is carried away from the conditioning gap by the continued rotation of the roller 176 and may eventually fall away from the rotating conditioning roll for collection in the supply bath 178. It will be understood that the DC power supply 174 is provided for maintaining an electrical bias on the applicator roll for generating a large electric field in the conditioning gap such that image areas of the electrostatic latent image on the photoconductive surface are compacted thereon.

In review, the present invention includes a method and apparatus for compacting a liquid ink developed image on an image bearing surface in a liquid ink type multicolor electrostatographic printing machine, particularly an image-on-image type multicolor machine. The image compacting apparatus includes a biased electrode situated proximate to the image on an image bearing surface, and a liquid applicator for depositing liquid insulating material in a conditioning gap defined by the electrode and the image bearing surface. A large electric potential is applied to the electrode for generating a large electric field in the gap to electrostatically compress toner particles into image areas on the image bearing surface. The liquid insulating material is deposited into the conditioning gap for avoiding the risk of air breakdown as may occur in an electrostatic device of this nature due to the small geometry of the apparatus and the tendency of air ionization in an air gap between electrically biased surfaces. Preferably, the liquid insulating material is the very same material utilized as the liquid carrier component of the liquid developing material.

It is, therefore, apparent that there has been provided, in accordance with the present invention, a method and apparatus for compacting a liquid ink developed image on an image bearing surface in a liquid ink type multicolor electrostatographic printing machine, particularly an image-on-image type multicolor machine. The method and apparatus described herein fully satisfies the aspects of the invention hereinbefore set forth. While this invention has been described in conjunction with specific embodiments thereof, it is evident that many alternatives, modifications and variations will be apparent to those skilled in the art. Accordingly, it is intended to embrace all such alternatives, modifications, and variations as fall within the spirit and broad scope of the appended claims.

We claim:

1. An apparatus for compacting a liquid ink developed image on an image bearing surface, comprising:

a conductive electrode having a surface situated proximate the image bearing surface, defining a conditioning gap therebetween;

a liquid material applicator for flooding said conditioning gap with a liquid insulating material; and an electrical bias source for applying an electrical bias to said electrode to create electric fields in the conditioning gap, wherein the electric fields electrostatically compress the developed image into image areas on the image bearing surface, while the liquid insulating material prevents air breakdown in the conditioning gap.

2. The apparatus of claim 1, wherein:

the liquid ink developed image is formed by depositing liquid developing material comprising toner particles immersed in a liquid carrier medium on the image bearing surface; and said liquid insulating material includes said liquid carrier medium.

3. The apparatus of claim 1, wherein the conditioning gap has a dimension of approximately 2–4 mils.

4. The apparatus of claim 1, wherein said liquid material applicator comprises a single piece housing defining an elongated aperture adapted for transporting the liquid insulating material into the conditioning gap.

5. The apparatus of claim 4 wherein the elongated aperture is situated substantially transverse to a path of travel of the image bearing surface.

6. The apparatus of claim 4, wherein said liquid material applicator further includes an input port coupled to the elongated aperture for supplying liquid insulating material thereto.

7. The apparatus of claim 4, wherein said liquid material applicator further includes means for allowing excess liquid insulating material to flow away from the image bearing surface.

8. The apparatus of claim 1, wherein said liquid material applicator includes a roller member situated proximate to image bearing surface for transporting the liquid insulating material into the conditioning gap.

9. The apparatus of claim 8, further including means for electrically biasing said roller member for electrostatically compressing the liquid developed image onto image areas on the image bearing surface.

10. A liquid ink type electrostatographic printing machine including an apparatus for compacting a liquid ink developed image on an image bearing surface, comprising:

a conductive electrode having a surface situated proximate the image bearing surface, defining a conditioning gap therebetween;

a liquid material applicator for flooding said conditioning gap with a liquid insulating material; and an electrical biasing source for applying an electrical bias to said electrode to create electric fields in the conditioning gap, wherein the electric fields electrostatically compress the developed image into image areas on the image bearing surface, while the liquid insulating material prevents air breakdown in the conditioning gap.

11. The apparatus of claim 10, wherein:

the liquid ink developed image is formed by depositing liquid developing material comprising toner particles immersed in a liquid carrier medium on the image bearing surface; and said liquid insulating material includes said liquid carrier medium.

12. The apparatus of claim 10, wherein the conditioning gap has a dimension of approximately 2–4 mils.

13. The apparatus of claim 10, wherein said liquid material applicator comprises a single piece housing defining an elongated aperture adapted for transporting the liquid insulating material into the conditioning gap.

14. The apparatus of claim 10, wherein said liquid material applicator includes a roller member situated proximate to image bearing surface for transporting the liquid insulating material into the conditioning gap.

15. The apparatus of claim 14, further including means for electrically biasing said roller member for electrostatically compressing the liquid developed image onto image areas on the image bearing surface.

16. A liquid ink type multicolor electrostatographic printing machine, wherein a plurality of liquid ink developed images are deposited in superimposed registration with one another on an imaging surface for creating a multicolored, multilayered image thereon, including an apparatus for compacting a liquid ink developed image layer on the imaging surface, comprising:

a conductive electrode having a surface situated proximate the imaging surface, defining a conditioning gap therebetween;

a liquid material applicator for flooding the conditioning gap with a liquid insulating material; and an electrical biasing source for applying an electrical bias to said electrode to create electric fields in the conditioning gap, wherein the electric fields electrostatically compress the developed image into image areas on the image bearing surface, while the liquid insulating material prevents air breakdown in the conditioning gap.

17. The liquid ink type multicolor electrostatographic printing machine of claim 16, wherein the liquid ink developed image is formed by depositing liquid developing material comprising toner particles immersed in a liquid carrier medium on the image bearing surface; and said liquid insulating material includes said liquid carrier medium.

18. The liquid ink type multicolor electrostatographic printing machine of claim 16, wherein the conditioning gap has a dimension of approximately 2–4 mils.

19. The liquid ink type multicolor electrostatographic printing machine of claim 16, wherein the liquid material applicator comprises a single piece housing defining an elongated aperture adapted for transporting the liquid insulating material into the conditioning gap.

20. The liquid ink type multicolor electrostatographic printing machine of claim 16, wherein the liquid material applicator includes a roller member situated proximate to image bearing surface for transporting the liquid insulating material into the conditioning gap.

21. The liquid ink type multicolor electrostatographic printing machine of claim 20, further including means for electrically biasing said roller member for electrostatically compressing the liquid developed image onto image areas on the image bearing surface.

22. A method for compacting a liquid ink developed image on an image bearing surface, comprising the steps of:

providing a conductive electrode having a surface situated proximate the image bearing surface, defining a conditioning gap therebetween;

flooding the conditioning gap with a liquid insulating material; and applying an electrical bias to said electrode to create electric fields in the conditioning gap, wherein the electric fields electrostatically compress the developed image into image areas on the image bearing surface, while the liquid insulating material prevents air breakdown in the conditioning gap.

* * * * *